United States Patent [19]

Neff et al.

[11] 4,177,840

[45] Dec. 11, 1979

[54] PRESSURE REGULATION AND FLOW CONTROL VALVE WITH COMBINATION NEEDLE AND CHECK VALVES

[75] Inventors: James A. Neff, Bloomfield Township, Oakland County; Richard A. Fagerlie, Union Lake, both of Mich.

[73] Assignee: MAC Valves, Inc., Wixom, Mich.

[21] Appl. No.: 865,390

[22] Filed: Dec. 29, 1977

[51] Int. Cl.[2] ..... F15B 11/04; F15B 13/042

[52] U.S. Cl. ..... 137/599; 91/443; 91/447; 137/505.18

[58] Field of Search ..... 91/443, 447; 137/493, 137/493.7, 493.8, 493.9, 599, 505.18

[56] References Cited

U.S. PATENT DOCUMENTS

| | | | |
|---|---|---|---|
| Re. 29,292 | 7/1977 | Tennis | 91/447 X |
| 598,579 | 2/1898 | Shields . | |
| 840,876 | 1/1907 | Steedman . | |
| 941,153 | 11/1909 | Krichbaum . | |
| 1,210,891 | 1/1917 | Blanchard . | |
| 2,141,715 | 12/1938 | Hilger . | |
| 2,285,049 | 6/1942 | Parks . | |
| 2,495,785 | 1/1950 | Stephens . | |
| 2,499,262 | 2/1950 | Stoudt . | |
| 2,501,483 | 3/1950 | Taylor | 91/443 X |
| 2,570,937 | 10/1951 | Gash . | |
| 3,186,307 | 1/1965 | Ellenbogen . | |
| 3,213,886 | 10/1965 | Pearne . | |
| 3,400,735 | 9/1968 | Favors | 137/505.18 X |
| 3,621,867 | 11/1971 | Johnson | 137/505.18 X |
| 3,951,162 | 4/1976 | Wilke . | |

FOREIGN PATENT DOCUMENTS

| | | |
|---|---|---|
| 5704 | 6/1901 | Fed. Rep. of Germany . |
| 1922073 | 11/1970 | Fed. Rep. of Germany . |
| 1224196 | 6/1960 | France . |
| 1431562 | 4/1976 | United Kingdom . |

*Primary Examiner*—Robert G. Nilson
*Attorney, Agent, or Firm*—Robert G. Mentag

[57] ABSTRACT

A combination pressure regulating and flow control valve which includes a valve body and cover means having an upstream port and a downstream port, and a fluid flow passage interconnecting said ports. An adjustable pressure regulator valve means is operatively mounted in said fluid flow passage. A check valve means is operatively mounted in parallel with said adjustable pressure regulator valve means, and it is operative to check the flow of fluid through said fluid flow passage when fluid is flowing through said fluid flow passage from the upstream port to the downstream port, and force it through the regulator valve means, and to allow flow of fluid through the check valve means when fluid is exhausted into said downstream port and out the upstream pressure port. A double acting, adjustable fluid flow control valve means is operatively mounted in said fluid flow passage which can provide either a meter in action or a meter out action in one direction with a free flow action in the other direction to the flow of fluid through said passage. The double acting, adjustable fluid flow control valve can also provide free flow action condition in both directions without any metering action. An adjustable quick exhaust valve means is included for quickly exhausting the downstream pressure through a second parallel fluid flow passage simultaneously with the exhaust of fluid flow through the first named passage and check valve means. The adjustable fluid flow control means includes a pair of needle valves that may be operatively mounted on a single valve stem, or on a pair of individual valve stems whereby both a meter in action and a meter out action can be provided without any free flow action.

15 Claims, 8 Drawing Figures

PRESSURE REGULATION AND FLOW CONTROL VALVE WITH COMBINATION NEEDLE AND CHECK VALVES

BACKGROUND OF THE INVENTION

1. Field of the Invention

This invention relates generally to valve mechanisms, and more particularly to an improved valve mechanism which combines the functions of pressure regulating and fluid flow control. The combination pressure regulating and flow control valve of the present invention is adapted for many uses as, for example, for controlling the operation of an air cylinder in either one direction or both directions.

2. Description of the prior art

It is known in the valve art to provide pressure regulation to individual or multiple directional control valves with single or multiple pressure regulators to control the pressure supplied to the device being controlled. The use of multiple pressure regulators is expensive and awkward requiring special directional control valves and excessive piping. Where multiple directional valves are mounted in stacking fashion or on a common manifold base, it is extremely difficult and expensive to provide pressure regulation to individual outlets. It is not common to use such pressure regulators in the line between the outlet or cylinder port of the directional valve and the device being controlled because of cost, space and the relatively short life of diaphragms and other components of pressure regulators. It is common to provide flow control means in the line between the directional control valve and the device being controlled. Because of cost, complexity and space requirements it has not been practicable in the past to provide both pressure regulator means and flow control means between the cylinder port of the directional control valve and the device being controlled. The result has been a waste of air requiring excessive pumping capacity, a waste of energy, and increase in the cost of using air as a power and control means.

SUMMARY OF THE INVENTION

In accordance with the present invention, a combination pressure regulating and flow control valve is provided which can be installed in any cylinder or actuation line to control both the pressure and the flow of air in that line. The combination valve of the present invention includes an adjustable pressure regulator valve means which is constructed and arranged to regulate the supply pressure to an air cylinder being controlled by the valve of the present invention. The valve of the present invention also includes an adjustable flow control valve for controlling the flow of air to or from the air cylinder being controlled by the valve. A spring biased check valve is in parallel with the adjustable pressure regulator valve and it is operable to provide return flow through the valve from a wide open or free flow condition to a metered out flow condition in cooperation with the adjustable flow control valve. In one embodiment, the adjustable flow control valve means may also be used in series with the adjustable pressure regulator valve means to provide either a metered in or metered out condition, with pressure regulation and flow control, and a free flow out or free flow in condition, respectively. Said one embodiment of the adjustable flow control valve means can also be adjusted to provide both a free flow in condition and a free flow out condition, without flow control, and with pressure regulation provided by the adjustable pressure regulator valve means. In a second embodiment, the adjustable flow control valve means can further provide both a metered in condition and a metered out condition, with pressure regulation provided by the adjustable pressure regulator valve means.

The combined pressure regulating and flow control valve of the present invention overcomes the disadvantages of the aforementioned prior art structures in that no separate pressure regulating device is required to reduce the pressure down to a required lower operating pressure, whereby a saving of air is provided at a minimum of cost. The pressure regulating and flow control valve of the present invention also provides a control over the speed of an air cylinder, whereby the air cylinder may be efficiently operated in either direction and at a savings of air. The valve of the present invention is advantageous in that it provides in one compact and economical unit the combined functions of pressure regulating and flow control.

The combination pressure regulating and flow control valve of the present invention also includes quick exhaust function which provides a quick dump exhaust characteristic in addition to the pressure regulating and flow control characteristics.

Other features and advantages of this invention will be apparent from the following detailed description, appended claims, and the accompanying drawings.

DESCRIPTION OF THE PREFERRED EMBODIMENTS

Figure 1:
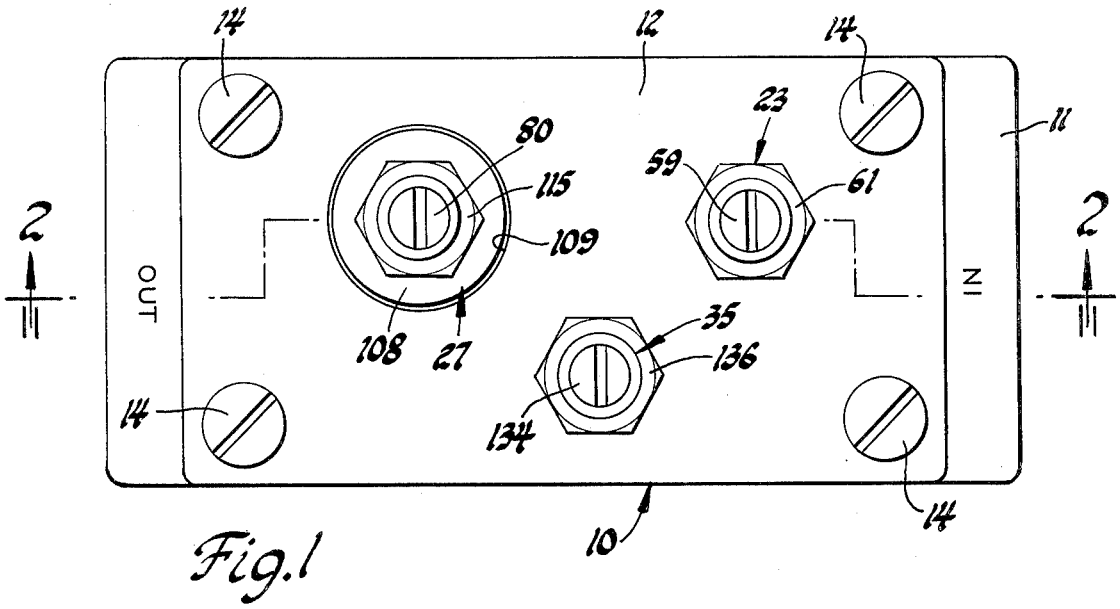
FIG. 1 is a top plan view of a first embodiment of a combination quick exhaust and flow control valve.
Figure 2:
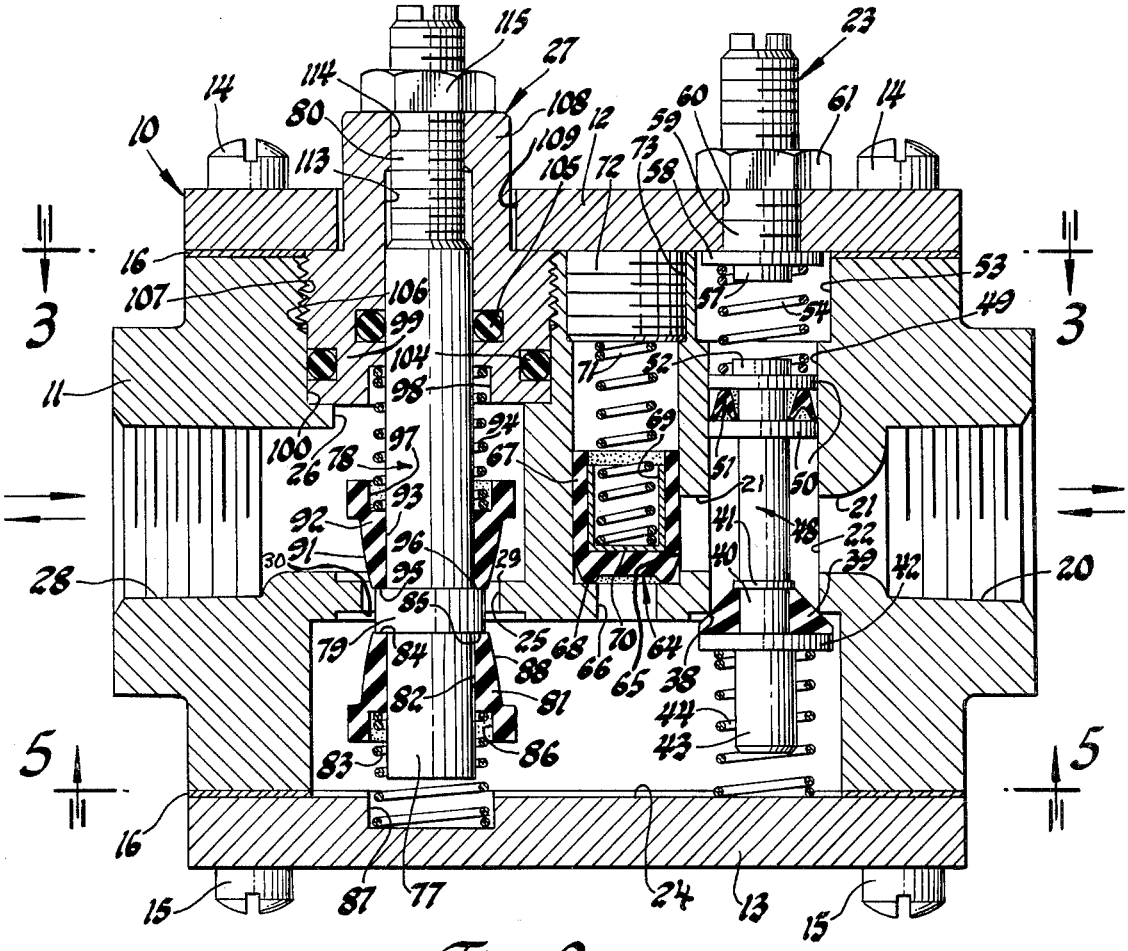
FIG. 2 is an elevation section view of the valve structure illustrated in FIG. 1, taken along the line 2—2 thereof, looking in the direction of the arrows, and showing a meter out function.
Figure 3:
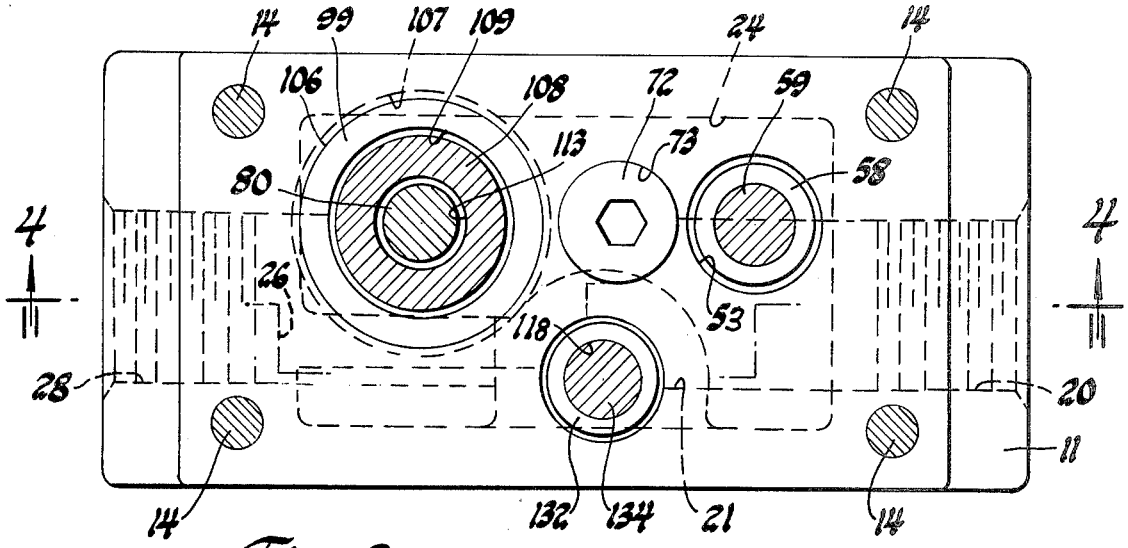
FIG. 3 is a top plan view of the valve body structure illustrated in FIG. 2, taken along the line 3—3 thereof, and looking in the direction of the arrows.

Referring now to the drawings, and in particular to FIGS. 1 and 2, the numeral 10 generally designates a first illustrative embodiment of a combination pressure regulating and flow control valve, with quick exhaust, made in accordance with the principles of the present invention. The valve 10 includes a valve body 11, a top end cover 12, and a bottom end cover 13. A suitable gasket 16 is disposed between the valve body 11 and both of the end covers 12 and 13. The top end cover 12 is secured to the valve body 11 by any suitable means, as by suitable machine screws 14. The bottom end cover 13 is secured to the valve body 11 by any suitable means, as by suitable machine screws 15. The valve body 11 is provided with a supply or upstream pressure port 20 which communicates with an inwardly extended passageway 21 which is formed in the valve body 11.

A vertical valve bore 22 is formed in the valve body 11, and it is disposed perpendicular to the passageway 21. A pressure regulator valve, generally indicated by the numeral 23, is operatively mounted in the bore 22. The bore 22 communicates at its lower end with an interior lower passageway 24 which is formed by the combined structure of the valve body 11 and the bottom end cover 13. The interior lower passageway 24 communicates through a bore 25 with an interior upper passageway or chamber 26 which in turn communicates with a downstream port 28. A double acting, adjustable fluid flow control means, generally indicated by the numeral 27, is operatively mounted through the bore 25. The double acting, adjustable fluid flow control means 27 includes a pair of floating needle valves, which are described more fully hereinafter, and which are adapted to function alternately for flow control purposes with two valve seats 29 and 30 which are formed at the orifices at the upper and lower ends of the bore 25.

Figure 4:
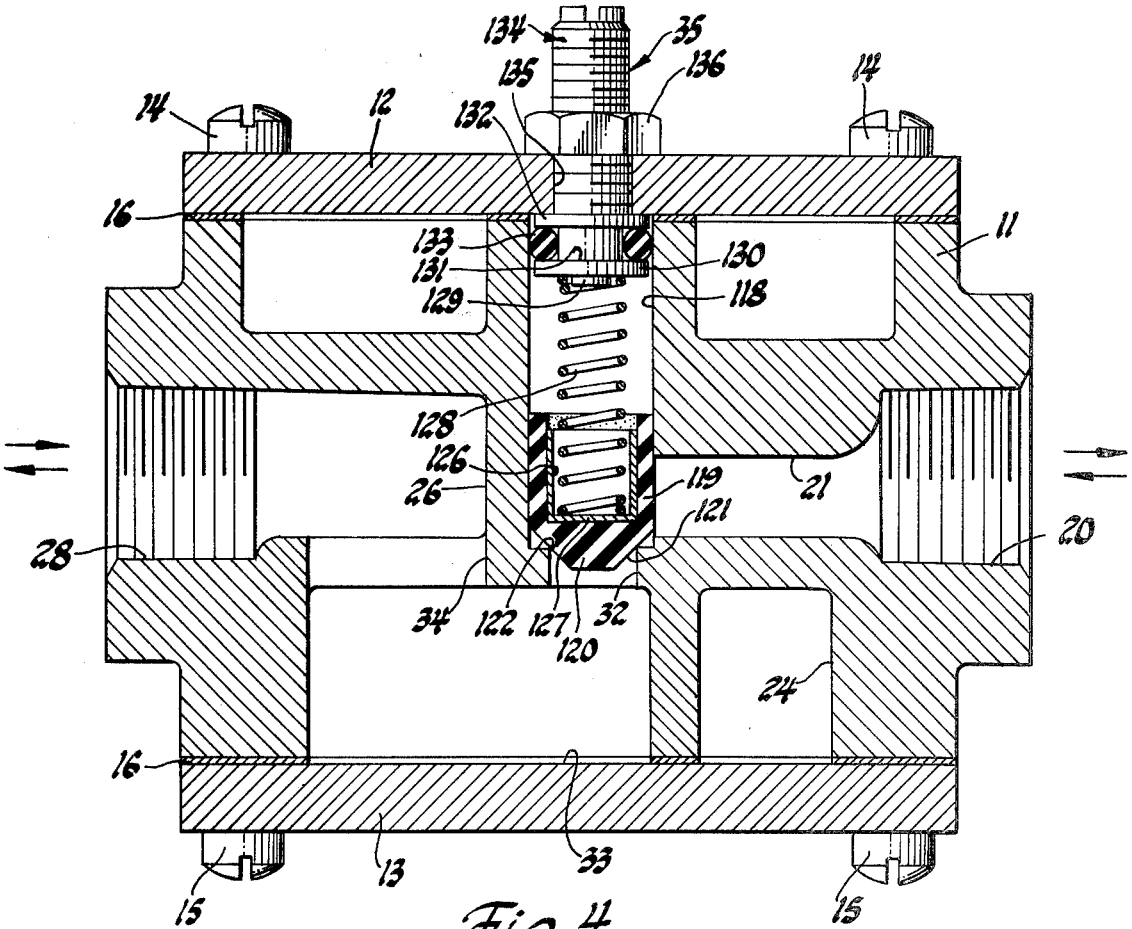
FIG. 4 is an elevation section view of the valve structure illustrated in FIG. 3, taken along the line 4—4 thereof, and looking in the direction of the arrows.
Figure 5:
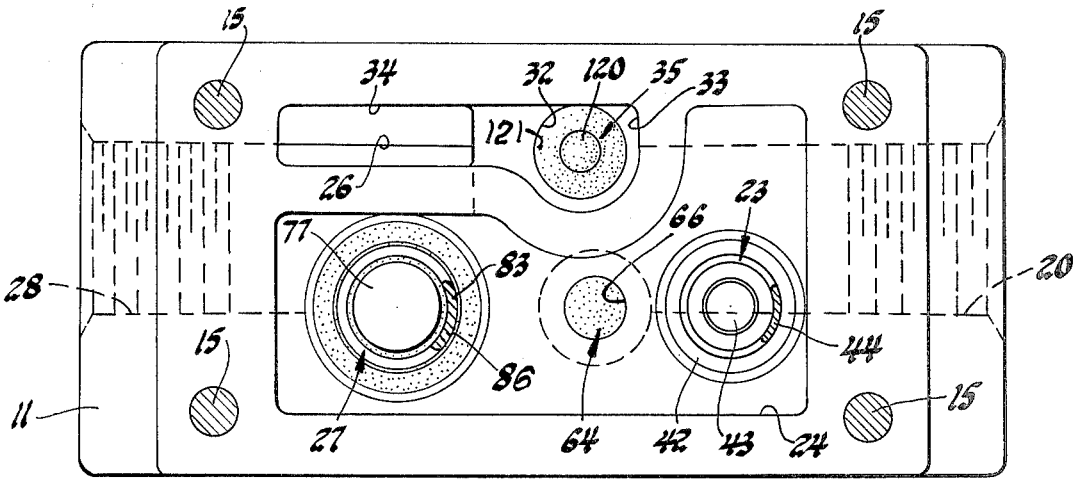
FIG. 5 is a bottom view of the valve body illustrated in FIG. 2, taken along the line 5—5, and looking in the direction of the arrows.

As shown in FIG. 4, an adjustable quick exhaust and check valve, generally indicated by the numeral 35, is operable for communicating the downstream port 28 with the upstream port 20. A bore 32 communicates the interior passageway 21 with a lower interior exhaust chamber or passageway 33, which is formed by the combined structure of the valve body 11 and the bottom end cover 13. The lower interior exhaust chamber 33 communicates with the upper interior chamber or passageway 26 through a connecting passageway 34.

The pressure regulator valve 23 is shown in detail in FIG. 2, and it is adapted to control the flow of fluid between the valve bore 22 and the lower interior passageway 24. As shown in FIG. 2, a valve seat 38 is formed at the lower end orifice of the bore 22, at the junction point between the valve bore 22 and the interior lower chamber 24. An inverted conical poppet valve element 39 is bonded to the lower portion 40 of a lower valve stem 48 which is movably mounted in the bore 22. The poppet valve element 39 terminates at its upper end at an integral, annular flange or shoulder 41 and at its lower end at a larger integral annular flange or shoulder 42. The poppet valve element 39 is lightly biased in the closing direction toward the valve seat 38 by a suitable spring 44 which is mounted around the enlarged lower end 43 of the valve stem 48. The lower end of the spring 44 abuts the inner face of the bottom end cover 13. The upper end of the spring 44 abuts the lower side of the annular shoulder 42.

As shown in FIG. 2, the upper end of the valve stem 48 is provided with a pair of annular shoulders or flanges 50 which are slidably mounted in the upper end 49 of the bore 22. A suitable seal 51 is mounted between the shoulders 50. A spring 54 has its lower end mounted in the bore portion 49 and it is seated around the upper end 52 of the valve stem 48. The spring 54 extends upward into an enlarged diameter bore 53 which communicates at its inner end with the bore 22, and which is open at the top end of the valve body 11, where it is enclosed by the top end cover 12. The upper end of the spring 54 is seated around a reduced diameter portion lower end of an adjustable upper valve stem 59. A radially extended annular shoulder or flange 58 is integrally formed on the valve stem 59 in a position spaced upwardly from the lower end of the valve stem 59, and the upper end of the spring 54 abuts against this shoulder. The valve stem 59 is threadably mounted in a threaded bore 60 formed through the top end cover 12. The outer and of the valve stem 59 is provided with a suitable tool slot for adjusting the valve stem 59 with a screw driver or the like. The valve stem 59 is shown in FIG. 2 in its maximum upward adjusted position. The valve stem 59 is locked in a desired adjusted position by a lock nut 61. It will be seen that the pressure regulator valve is essentially a balanced spring biased poppet valve. The upper valve stem 59 is adjusted downwardly or inwardly to bias the poppet valve element 39 off of the valve seat 38 to the open position to allow a flow of air past the poppet valve element 39 whenever air or other fluid is entering through the inlet or supply port 20. When flow starts, the downstream pressure exerts a force on the area of the poppet valve element 39, exposed to said downstream pressure. When such force equals the force exerted by the adjustable spring 54 the valve element 39 will close to flow, being urged by the fixed spring 44 to the closed position on the valve seat 38. It will be understood that the pressure required to move the poppet valve element 39 upwardly to the closed position is dependent upon the spring force exerted thereon by the spring 54. In the closed position, the force of the inlet fluid pressure is balanced between the inlet valve seat 38 and the pressure balancing seal means 51. Therefore, variations in inlet pressure can cause only small variations in the downstream pressure.

As shown in FIG. 2, the passageway 21 communicates with a vertical valve bore 65 which in turn communicates at its lower end through a bore or passageway 66 with the lower interior passageway 24. A check or relief valve means, generally indicated by the numeral 64, is ooperatively mounted within the valve bore 65 for controlling the flow of air or other fluid through the bore 66 which is smaller in diameter than the valve seat 38. The check valve means 64 includes a cup-shaped valve body 67 having an open upper end, and which is made from a suitable elastometic material, and provided with a cup-shaped liner 70 that is made from any suitable material, as for example, stainless steel. As shown in FIG. 2, a suitable spring 71 has its lower end mounted within the chamber 69 of the liner 70, and its upper end extended upwardly and seated against the inner end face of a plug 72. The plug 72 is threadably mounted in a threaded bore 73 that is open at the upper end of the body 11, and which communicates at its inner end with the valve bore 65. The cup-shaped valve body 67 is provided on its closed lower end with an integral, annular, axially extended projection 68 which is adapted to be seated around the upper end of the passageway or bore 66 for enclosing the same in a valve closing action. It will be seen that the spring 71 normally biased the check valve 64 into a closed position, as shown in FIG. 2, to prevent flow of air or other fluid from the upstream passage 20 down through the bore 66 into the interior lower passageway 24. However, when the flow of fluid through the valve is in the reverse direction, that is from the lower interior passageway 24, the check valve 64 would be biased upwardly by the returning fluid flow pressure and moved to an open position to permit the fluid to exhaust through the bore 66 and into the bore 65, and thence into the passageway 21 and out the port 20, so as to reduce the pressure in the lower passageway 24 to allow the regulator valve element 39 to open and provide flow past the regulator valve as well as past the check valve 64.

As shown in FIG. 2, the double acting, adjustable fluid flow control means 27 includes an elongated valve stem, generally indicated by the numeral 78, which is vertically disposed in the valve body 11, at right angles to the ports 20 and 28. The valve stem 78 is disposed so as to extend downwardly through the passageway 25, with its lower end 77 disposed in the interior lower passageway 24. An integral, annular shoulder or flange 79 is formed on the lower portion of the valve stem 78. A lower needle valve 81 is slidably mounted on the lower end portion 77 of the valve stem 78, and it has a conically shaped outer face 88. The needle valve 81 has an axial bore 82 which receives the valve stem portion 77. The needle valve bore 82 communicates with an enlarged bore 86 formed at the lower end of the needle valve 81. The needle valve 81 is disposed with its conically shaped outer face 88 facing upwardly, so as to operate in relation to the lower valve seat 30 at the lower end of the passage 25. A spring 83 is mounted around the lower end 77 of the valve stem 78, and it has its upper end seated in the enlarged bore 86 formed in the lower end of the needle valve 81. The lower end of the spring 83 is seated in a recess 87 formed in the inner face of the bottom end cover 13. The upper end of the needle valve 81 is flat, as indicated by the numeral 84, and it is adapted to be normally seated on the flat lower face 85 of the shoulder 79. The spring 83 normally biases the needle valve 81 upwardly into seating engagement against the lower face 85 of the shoulder 79.

A second needle valve 92 is provided with an axial bore 93 which terminates in an enlarged bore 97 at the top end thereof, as shown in FIG. 2. The needle valve 92 is slidably mounted on the valve stem 78, in a position above the shoulder 79. The needle valve 92 is provided with a conically shaped outer face 91 which is adapted to operate with the upper valve seat 29 that is formed at the upper end of the passageway 25. The front end of the upper needle valve 92 is disposed downwardly in opposite relationship to the front end of the lower needle valve 81. The front end of the needle valve 92 is flat, as indicated by the numeral 95, and this flat front end is adapted to be normally seated on the flat upper face 96 of the shoulder 79. A spring 94 is mounted around the valve stem 78, in a position above the needle valve 92, and the lower end thereof is seated in the enlarged bore 97 formed in the rear end of the needle valve 92. The upper end of the spring 94 is seated in an enlarged bore 98 that is formed in the lower end of a valve stem retainer which has a large diameter lower end 99 and a small diameter upper end 108 which extends upwardly and through a circular opening 109 formed in the top end cover 12.

The valve stem 78 extends upwardly through the enlarged bore 98 and a communicating reduced diameter bore 113, and thence through a reduced diameter threaded bore 114, in the upper end of the retainer upper end portion 108. The upper end 80 of the valve stem 78 is threaded, and it is threadably mounted in the threaded bore 114 for adjusting the valve stem upwardly and downwardly. The valve stem 78 is secured in a desired adjusted position by a suitable lock nut 115. The lower end of the retainer large diameter portion 99 is slidably mounted in a bore 100 that is formed in the valve body 11 and which communicates with the upper end of the upper interior passageway 26. The upper end of the retainer large diameter lower portion 99 is threaded on its periphery, as indicated by the numeral 106, and it is threadably mounted in the upper threaded portion 107 of the bore 100. As shown in FIG. 2, a suitable O-ring seal 104 is operatively mounted in a groove formed around the valve stem retainer lower end portion for operative engagement with the bore 100. An O-ring seal means 105 is mounted in an internal groove formed in the valve stem retainer lower end portion 99, and it operatively engages the outer periphery of the valve stem 78.

As shown in FIG. 2, the double-acting, adjustable fluid flow control means 27 is shown in an adjusted position whereby fluid passing from the lower interior passageway 24 upwardly through the passage 25 and into the upper interior passage 26, and out the port 28, will be carried in a free flow manner, since the fluid under pressure will move the upper needle valve 92 upwardly against the pressure of the spring 94 to provide a free flow action.

When the flow of fluid to the valve 10 is reversed, the fluid under pressure will engage the top of the needle valve 92, and function with the spring 94 to maintain the needle valve 92 in the position shown in FIG. 2, with its lower end 95 in seating engagement on the upper shoulder 96 of the flange 79. The returning or exhausting fluid will have to pass between the conical outer face 91 of the needle valve 92 and the upper valve seat 29, in a desired flow control condition, whereby the fluid is metered out during its return flow through the valve 10. The pressure regulator valve 23, and the double acting, fluid flow control means 27 are disposed in FIG. 2 so as to provide free flow in and a meter out function. It will be understood that when the fluid is exhausting past the needle valve 92 in a meter out action, that it will pass down into the lower interior passageway 24 and thence upwardly past the check valve 64 and into the passageway 21 and out the port 20.

Figure 6:
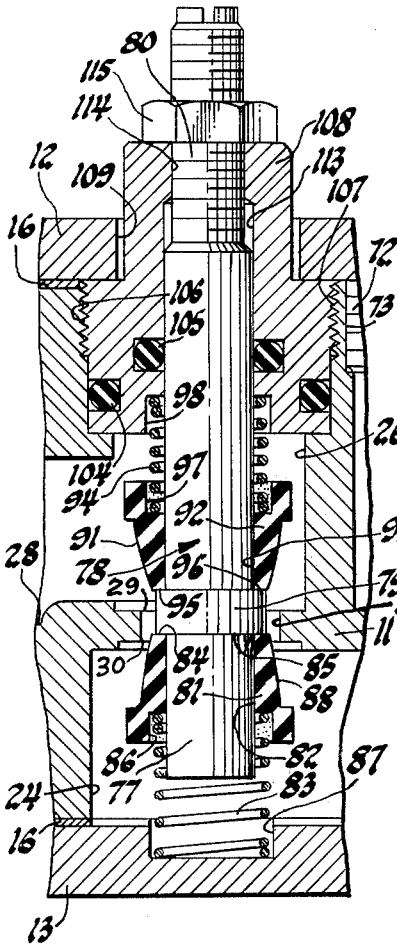
FIG. 6 is a fragmentary, elevation section view of the embodiment of FIGS. 1–5 adjusted to provide a meter in function.

FIG. 6 shows the fluid flow control valve 27 adjusted upwardly so as to move the lower needle valve 81 upwardly into an operative relationship with the lower valve seat 30, whereby a meter in action is provided, since the fluid flowing from the lower interior passageway 24 upwardly into the upper passageway 26 will function with the spring 83 to maintain the needle valve 81 in the position shown in FIG. 6 against the shoulder 79. The fluid flowing past the outer conical face 88 of the needle valve 81 and through the orifice at the valve seat 30 is thus provided with a meter in function. When the fluid is flowing in the reverse manner through the structure shown in FIG. 6, the fluid will flow with a free flow out action. It will be understood that the valve stem 78 may be adjusted downwardly from the position shown in FIG. 6, so as to move the lower needle valve 81 out of the area of the valve seat 30 into an inoperative position. The upper needle valve 92 would be in a similar inoperative position raised above and out of the area of the upper valve seat 29, so as to provide a free flow of fluid in and out of the valve 10 while passing through the passageway 25.

As shown in FIG. 4, the adjustable quick exhaust and check valve means 35 is operatively mounted in a vertical bore 118 that extends into the valve body 11 from the upper end thereof, and which communicates at its lower end with the internal passageway 21. The passageway or bore 32 communicates the lower end of the valve bore 118 with the lower interior exhaust chamber 33. The adjustable quick exhaust and check valve means 35 includes a cup-shaped valve body member 119 which is made from a suitable elastomeric material. The valve body 119 functions as a check valve, and it is provided with a conically shaped nose 120 which has a sloping surface 121 that is adapted to be normally seated on a valve seat 122 that is formed at the upper end of the passage 32.

The valve 119 is provided with a cup-shaped liner 127. The lower end of a spring 128 is seated in the interior chamber 126 of the liner 127. The upper end of the spring 128 is seated around the lower end 129 of an adjustable valve stem, generally indicated by the numeral 134. The upper end of the spring 128 abuts the lower side of an integral annular shoulder or flange 130 that is formed on the lower or inner end of the valve stem 134. A second integral annular shoulder 132 is formed on the valve stem 134 in a position spaced apart from the shoulder 130 to form a groove 131 therebetween in which is operatively seated an O-ring seal 133. The O-ring seal 133 operatively engages the surface of the bore 118.

The valve stem 134 is threadably mounted in a threaded bore 135 which is formed through the top cover 12, and which communicates with the upper end of the valve bore 118 in the valve body 11. The valve stem 134 is secured in a desired adjusted position by a suitable lock nut 136. It will be seen that the valve stem 134 can be adjusted inwardly from its maximum raised position shown in FIG. 4, so as to exert a desired spring pressure on the cup-shaped check valve 119 to control the fluid pressure under which the valve 119 will open to allow fluid to exhaust from the port 28 and through the passageways 34, 33 and 32, and into the passageway 21 and out the port 20.

In use, the combination pressure regulating and flow control valve means 10 illustrated in FIGS. 1 through 6 is adapted to provide a pressure regulating function when the fluid flow is in one direction, and a metering out or flow control function when the fluid flow is in the other direction. With supply air flowing into the chamber 21 through the port 20, the air is blocked by the check valve 64 from passing through the passageway 66, but it is permitted to flow downwardly through the bore 22 into the interior lower passageway 24 because the valve 23 is adjusted so that the poppet valve element 39 is in an open position to allow flow into the passageway 24. The air cannot pass from the chamber 21 past the quick exhaust valve 35 since this valve acts as a check valve. The air in the lower interior passageway 24 passes upwardly past the lower needle valve 81 which is in an inoperative position, and upwardly through the passage 25 in a free flow past the upper needle valve 92 into the upper interior chamber 26 and out the port 28. The pressure of the air flowing through the passageway 25 moves the upper needle valve 92 upwardly against the pressure of the spring 94 to an open position to permit the free flow of the fluid thereby. When the downstream pressure builds up in the lower interior chamber 24 to a predetermined force equal to the force exterted by the adjustable spring 54, the poppet valve element 39 will be moved to a closed position by the fixed spring 44.

When air is exhausted into the downstream port 28 and into the upper interior chamber 26 in a reverse flow, it will force the needle valve 92 downwardly against the shoulder 79, and air will pass downwardly around the needle valve 92, and through the valve seat 29, to provide a metering out action on the exhausting air. The air passing down into the lower interior chamber 24 will open the relief or check valve 64 to reduce the pressure in the lower chamber 24 so that the regular valve element 39 will open. The quick exhaust valve 35 can be set so as to open at any desired condition, as for example, to quickly reduce the pressure in the chamber 24 to a predetermined level quickly to allow the regulator valve element 39 to open and thus reduce the pressure quickly on the head end of a cylinder to start the piston moving back.

It will be seen that the valve stem 78 can be adjusted upwardly to the position shown in FIG. 6 to provide a metering in function and a free flow out function. It will also be understood that the valve stem 78 can be so adjusted to a position wherein the needle valves 81 and 92 are inoperative to allow free flow past both valves, whereby the valve 10 then permits a free flow in function and a free flow out function, without any metering action whatsoever. It will be understood that the quick exhaust valve 35 may be adjusted to keep it closed during a meter in function or be adjusted as desired to reduce the downstream pressure to a predetermined level.

It will be seen from the foregoing, that the embodiment of FIGS. 1 through 6 provides a pressure regulating and flow control valve, wherein a pair of needle valves are movably mounted on a single valve stem so that they can float in one direction against a spring pressure and be held against movement in the other direction by a common shoulder on the valve stem. It will be seen that the embodiment of FIGS. 1 through 6 can be adjusted to provide a regulated, free flow in function, with a meter out function, or a regulated, meter in function with a free flow out function, or a regulated free flow in function with a free flow out function. The regulator valve means can be adjusted to provide any of said free flow and metering functions without the regulating function. An advantage of the structure of the embodiment of FIGS. 1 through 6 is that all of the seals are in the valve body or in the retainer member, and not in the top end cover, whereby a structure is provided wherein the critical dimensions are easily held or met during machining operations on the valve body 11. The last mentioned feature provides a cost advantage, since the number of parts needed to be handled when machining critical dimensions is reduced, and the parts handling time is reduced.

Figure 7:
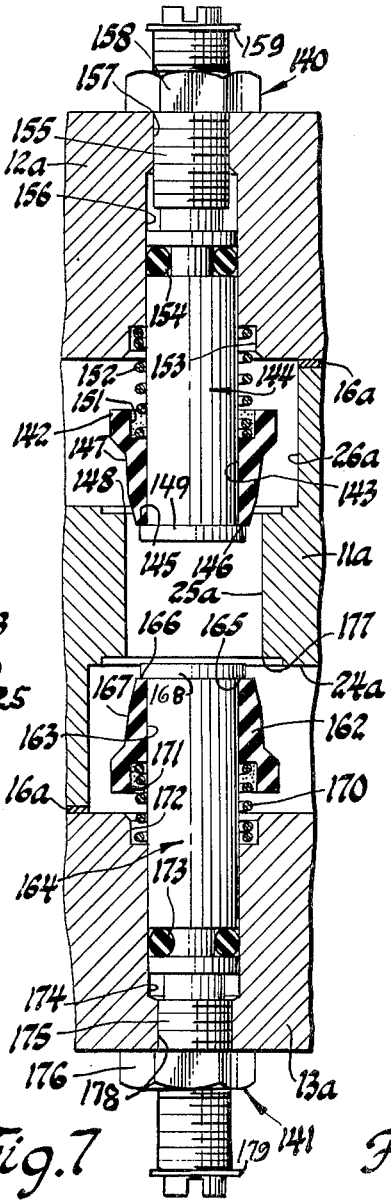
FIG. 7 is a fragmentary, elevation section view of a second embodiment of the invention, and showing a meter out function.
Figure 8:
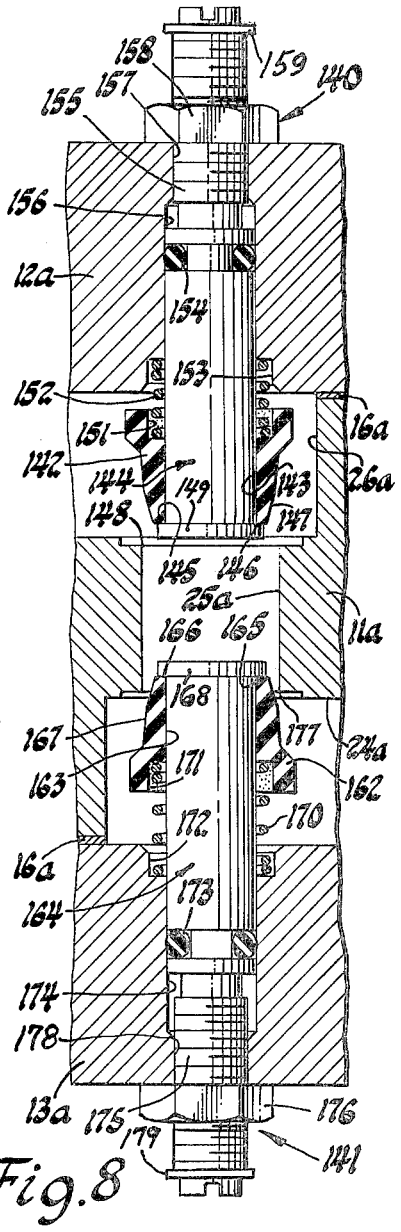
FIG. 8 is a fragmentary, elevation section view identical to FIG. 7, and showing the valve structure of the second embodiment adjusted to provide a meter in function.

FIGS. 7 and 8 illustrate a second embodiment of the invention wherein the pair of flow control needle valves are each mounted on an individual valve stem. As shown in FIGS. 7 and 8, the parts of the second embodiment which are the same as parts of the first embodiment of FIGS. 1 through 6 have been marked with the same reference numerals followed by the small letter "a". The numeral 140 generally designates a first flow control valve means which is mounted in an upper position while the numeral 141 generally designates a second flow control valve mounted in an opposed, lower position. The upper flow control valve means 140 includes a needle valve 142 which has an axial bore 143 therethrough for slidably mounting the needle valve 142 on a valve stem generally, indicated by the numeral 144. The needle valve 142 is provided with a flat end 146 on the front end thereof, which is adapted to be seated on the flat upper side 145 of an annular shoulder or flange 149 that is formed on the lower or inner end of the valve stem 144. The needle valve 142 is provided with a conically shaped outer face 147 which terminates at its upper end in a tapered shoulder, as compared to the flat shoulders on the needle valves 81 and 92 in the first embodiment of FIGS. 1 through 6. The needle valve 142 is adapted to operate in relation to a valve seat 148 for controlling the flow of fluid therethrough, and through the passage 25*a*.

The needle valve 142 is normally biased downwardly for seating engagement on the shoulder 149 by a spring 152. The lower end of the spring 152 is seated in an enlarged bore 151 in the upper end of the needle valve 142. The upper end of the spring 152 is seated in an enlarged bore 153 formed in the top end cover 12*a*. The valve stem 144 is slidably mounted in a bore 156 formed in the top end cover 12*a*. The valve stem 144 has an O-ring 154 operatively mounted in a groove around its periphery for sealing engagement with the bore 156. The upper end of the valve stem 144 is threaded, as indicated by the numeral 155, and it is threadably mounted in a threaded bore 157 which is a continuation of the bore 156 in the top end cover. The valve stem 144 is adapted to be locked in an adjusted position by a lock nut 158. The numeral 159 designates a snap ring that functions as a stop member to limit the inward adjustment of valve stem 144.

The lower flow control valve means 141 includes a needle valve 162 which has an axial bore 163 therethrough for slidably mounting the needle valve 162 on a valve stem, generally indicated by the numeral 164. The needle valve 162 is provided with a flat front end 166 which is adapted to be seated on the flat lower side 165 of the annual shoulder 168 which is formed on the upper or inner end of the valve stem 164. The needle valve 162 is provided with a conically shaped outer face 167 which terminates at its lower end in a tapered shoulder, in the same manner as the needle valve 142. The needle valve 162 is normally biased against the shoulder 168 by a spring 170 which has its upper end seated in an enlarged bore 171 formed in the rear end of the needle valve 162. The other end of the spring 170 is seated in an enlarged bore 172 formed in the bottom end cover 13*a*. The valve stem 164 is slidably mounted in a bore 174 in the bottom end cover 13*a*. The valve stem 164 is provided with a suitable O-ring seal means 173 for sealing engagement with the bore 174. The lower end 175 of the valve stem 164 is threaded and it extends out of the bottom end cover 13*a*. The threaded lower end 175 of the valve stem 164 is threadably mounted in a threaded bore 178. The valve stem 164 is locked in an adjusted position by a lock nut 176. The numeral 179 designates a snap ring that functions like snap ring 159.

As shown in FIG. 7, the second embodiment is positioned with the upper needle valve 142 in an operative position relative to the valve seat 148 so as to provide a free flow in function for fluid passing through the valve, and a metering out function on fluid being exhausted through the valve. The lower needle valve 162 is withdrawn into an inoperative position to allow free flow past this valve for fluid flowing in either direction through the valve.

FIG. 8 shows the needle valves 142 and 162 reversed in position so that the lower needle valve 162 provides a metering in function and a free flow out function while the upper needle valve 142 is positioned in an inoperative position to permit free flow of fluid thereby in each direction.

The embodiment of FIGS. 7 and 8 can carry out the same functions as described hereinbefore for the first embodiment of FIGS. 1 through 6. The embodiments of FIGS. 7 and 8 can carry out a further function over the first embodiment in that the needle valves 142 and 162 can both be moved inwardly to an operative position relative to their respective valve seats so as to provide both a metering in function and a metering out function.

While it will be apparent that the preferred embodiments of the invention herein disclosed is well calculated to fulfill the objects above stated, it will be appreciated that the invention is susceptible to modification, variation and change.

What is claimed is:

1. In a combination pressure regulating and flow control air valve for controlling fluid flow through a fluid flow circuit which includes a fluid controlled apparatus, the combination comprising:

(a) a valve body and cover means having an upstream pressurized fluid supply port for connection to a source of pressurized fluid, and a downstream working port for connection to the fluid controlled apparatus in said fluid flow circuit, and a fluid flow passage interconnecting said ports;

(b) an adjustable pressure regulator valve means operatively mounted in said fluid flow passage to provide a regulated downstream pressure at the downstream working port when fluid is flowing from the source of pressurized fluid into the upstream port and to the downstream port;

(c) a check valve means operatively mounted in said fluid flow passage in parallel with the pressure regulator valve means and operative to force the flow of fluid through said pressure regulator valve means when fluid is flowing through said fluid flow passage from said upstream port to said downstream port, and allow flow past said pressure regulator valve means and reduce pressure in said fluid flow passage to allow the pressure regulator valve to open when fluid is exhausted from said downstream port and through said fluid flow passage and out the upstream pressure port; and, (d) an adjustable, double acting, fluid flow control valve means operatively mounted in said fluid flow passage downstream from said adjustable pressure regulator valve means, and in series with said check valve means to provide a selective metering action to the flow of fluid through said fluid flow passage from either port to the other port.

2. In a combination pressure regulating and flow control air valve, for controlling fluid flow through a fluid flow circuit which includes a fluid controlled apparatus, the combination comprising:

(a) a valve body and cover means having an upstream pressurized fluid supply port for connection to a source of pressurized fluid and a downstream working port for connection to the fluid controlled apparatus in said fluid flow circuit, and a fluid flow passage interconnecting said ports;

(b) an adjustable pressure regulator valve means operatively mounted in said fluid flow passage to provide a regulated downstream pressure at the downstream working port when fluid is flowing from the source of pressurized fluid into the upstream port and to the downstream port;

(c) a check valve means operatively mounted in said fluid flow passage in parallel with the pressure regulator valve means and operative to force the flow of fluid through said pressure regulator valve means when fluid is flowing through said fluid flow passage from said upstream port to said downstream port, and to reduce pressure in said fluid flow passage and allow flow past said pressure regulator valve means when fluid is exhausted from said downstream port and through said fluid flow passage and out the upstream pressure port;

(d) an adjustable, double acting, fluid flow control valve means operatively mounted in said fluid flow passage downstream from said adjustable pressure regulator valve means, and in series with said check valve means to provide a metering action to the flow of fluid through said fluid flow passage; and, (e) said adjustable fluid flow control valve means being operatively mounted in said fluid flow passage to provide free flow of the fluid when fluid is flowing through said fluid flow passage from said upstream port to said downstream port, and to provide a meter out action when fluid is exhausted from said downstream port through said fluid flow passage and out the upstream port.

3. A combination pressure regulating and flow control valve structure as defined in claim 1, wherein:

(a) said adjustable fluid flow control valve means is operatively mounted in said fluid flow passage to provide a meter in action when fluid is flowing through said fluid flow passage from said upstream port to said downstream port, and to provide a free flow of fluid when fluid is exhausted from said downstream port through said fluid flow passage and out the upstream port.

4. A combination pressure regulating and flow control valve structure as defined in claim 1, wherein:

(a) said adjustable fluid flow control valve means is operatively mounted in said fluid flow passage to provide free flow of the fluid when fluid is flowing from said upstream port to said downstream port, and to provide free flow of the fluid when fluid is exhausted from said downstream port through said fluid flow passage and out the upstream port.

5. In a combination pressure regulating and flow control air valve, for controlling fluid flow through a fluid flow circuit which includes a fluid controlled apparatus, the combination comprising:

(a) a valve body and cover means having an upstream pressurized fluid supply port for connection to a source of pressurized fluid and a downstream working port for connection to the fluid controlled apparatus in said fluid flow circuit, and a fluid flow passage interconnecting said ports;

(b) an adjustable pressure regulator valve means operatively mounted in said fluid flow passage to provide a regulated downstream pressure at the downstream working port when fluid is flowing from the source of pressurized fluid into the upstream port and to the downstream port;

(c) a check valve means operatively mounted in said fluid flow passage in parallel with the pressure regulator valve means and operative to force the flow of fluid through said pressure regulator valve means when fluid is flowing through said fluid flow passage from said upstream port to said downstream port, and to reduce pressure in said fluid flow passage and allow flow past said pressure regulator valve means when fluid is exhausted from said downstream port and through said fluid flow passage and out the upstream pressure port;

(d) an adjustable, double acting, fluid flow control valve means operatively mounted in said fluid flow passage downstream from said adjustable pressure regulator valve means, and in series with said check valve means to provide a metering action to the flow of fluid through said fluid flow passage; and, (e) said adjustable fluid flow control valve means being operatively mounted in said fluid flow passage to provide a meter in action when fluid is flowing through said fluid flow passage from said upstream port to said downstream port, and to provide a meter out action when fluid is exhausted from said downstream port through said fluid flow passage and out the upstream port.

6. In a combination pressure regulating and flow control valve, the combination comprising:

(a) a valve body and cover means having an upstream port and a downstream port, and a fluid flow passage interconnecting said ports;

(b) an adjustable pressure regulator valve means operatively mounted in said fluid flow passage to provide a regulated downstream pressure at the downstream pressure port;

(c) a check valve means operatively mounted in said fluid flow passage in parallel with the pressure regulator valve means and operative to force the flow of fluid through said pressure regulator valve means when fluid is flowing through said fluid flow passage from said upstream port to said downstream port, and to reduce pressure in said fluid flow passage and allow flow past said pressure regulator valve means when fluid is exhausted from said downstream port and through said fluid flow passage and out the upstream pressure port;

(d) an adjustable fluid flow control valve means operatively mounted in said fluid flow passage to provide a metering action to the flow of of fluid through said fluid flow passage; and, (e) said adjustable fluid flow control valve means comprising:

(1) a pair of valve members movably mounted on adjustable valve stem means; and, (2) means for normally biasing each of the valve members to a first position and operative to allow the valve members to be moved to a second position by fluid flowing through said fluid flow passage in a direction opposite to the action of said biasing means.

7. A combination pressure regulating and flow control valve structure as defined in claim 6, wherein:

(a) said valve members each comprise a needle valve.

8. A combination pressure regulating and flow control valve structure as defined in claim 6, wherein:

(a) both of said pair of valve members are movably mounted in opposing positions on a common adjustable valve stem.

9. A combination pressure regulating and flow control valve structure as defined in claim 6, wherein:

(a) each of said pair of valve members is movably mounted on an individual adjustable valve stem and in opposing positions relative to each other.

10. A combination pressure regulating and flow control valve structure as defined in claim 9, wherein:

(a) each of said adjustable valve members are operatively mounted in said fluid flow passage to provide a meter in action when fluid is flowing through said fluid flow passage from said upstream port to said downstream port, and to provide a meter out action when fluid is exhausted from said downstream port through said fluid flow passage and out the upstream port.

11. A combination pressure regulating and flow control valve structure as defined in claim 6, wherein:

(a) said valve member biasing means comprises a spring means.

12. A combination pressure regulating and flow control valve structure as defined in claim 6, wherein said adjustable pressure regulator valve means includes:

(a) a poppet valve element;

(b) means for biasing said poppet valve element in a closing direction; and, (c) means for biasing said poppet valve element in an opening direction.

13. A combination pressure regulating and flow control valve structure as defined in claim 12, wherein:

(a) said means for biasing said poppet valve element in a closing direction comprises a spring means.

14. A combination pressure regulating and flow control valve structure as defined in claim 12, wherein:

(a) said means for biasing said poppet valve element in an opening direction comprises an adjustable spring means.

15. In a combination pressure regulating and flow control valve, the combination comprising:

(a) a valve body and cover means having an upstream port and a downstream port, and a fluid flow passage interconnecting said ports;

(b) an adjustable pressure regulator valve means operatively mounted in said fluid flow passage to provide a regulated downstream pressure at the downstream pressure port;

(c) a check valve means operatively mounted in said fluid flow passage in parallel with the pressure regulator valve means and operative to force the flow of fluid through said pressure regulator valve means when fluid is flowing through said fluid flow passage from said upstream port to said downstream port, and to reduce pressure in said fluid flow passage and allow flow past said pressure regulator valve means when fluid is exhausted from said downstream port and through said fluid flow passage and out the upstream pressure port;

(d) an adjustable fluid flow control valve means operatively mounted in said fluid flow passage to provide a metering action to the flow of fluid through said fluid flow passage; and, (e) an adjustable, spring biased valve means operative mounted in a second fluid flow passage which is parallel to the first named fluid flow passage, to allow free flow back to the upstream port if the pressure regulator valve means is closed to such flow.

* * * * *